US005189885A

United States Patent [19]

Ni

[11] Patent Number: 5,189,885

[45] Date of Patent: Mar. 2, 1993

[54] RECIRCULATING REFRIGERATION SYSTEM

[75] Inventor: Shimao Ni, Westmont, Ill.

[73] Assignee: H. A. Phillips & Co., St. Charles, Ill.

[21] Appl. No.: 789,164

[22] Filed: Nov. 8, 1991

[51] Int. Cl.[5] ..... F25B 43/00

[52] U.S. Cl. ..... 62/117; 62/503; 62/509

[58] Field of Search ..... 62/117, 503, 509

[56] References Cited

U.S. PATENT DOCUMENTS

| | | | |
|---|---|---|---|
| 1,000,723 | 8/1911 | Dettmar . | |
| 1,106,244 | 8/1914 | Schliemann . | |
| 1,106,287 | 8/1914 | Doelling . | |
| 2,032,286 | 2/1936 | Kitzmiller . | |
| 2,123,021 | 7/1938 | Ross . | |
| 2,164,081 | 6/1939 | Phillips et al. . | |
| 2,267,152 | 12/1941 | Gygax . | |
| 2,570,979 | 10/1951 | Phillips . | |
| 2,589,859 | 3/1952 | Phillips . | |
| 2,590,741 | 3/1952 | Watkins . | |
| 2,655,008 | 10/1953 | Sloan et al. . | |
| 2,778,195 | 1/1957 | Christensen . | |
| 2,836,966 | 6/1958 | Kocher et al. . | |
| 2,841,962 | 7/1958 | Richards . | |
| 2,871,673 | 2/1959 | Richards et al. . | |
| 2,952,137 | 9/1960 | Watkins . | |
| 3,315,484 | 4/1967 | Ross . | |
| 3,352,124 | 11/1967 | Watkins | 62/509 X |
| 3,643,460 | 2/1972 | Garland . | |
| 3,827,249 | 8/1974 | Garland et al. . | |
| 3,848,425 | 11/1974 | Watkins . | |
| 3,919,859 | 11/1975 | Ross | 62/509 X |
| 3,988,904 | 11/1976 | Ross . | |
| 4,059,968 | 11/1977 | Ross et al. . | |
| 4,324,106 | 4/1982 | Ross et al. . | |
| 4,815,298 | 3/1989 | Van Steenburg | 62/509 X |

*Primary Examiner*—Stephen M. Hepperle

*Attorney, Agent, or Firm*—Willian, Brinks, Olds, Hofer, Gilson & Lione

[57] ABSTRACT

An improved gas pumping recirculating refrigeration system is disclosed. A controlled pressure flash tank provides flash gas for forcing liquid refrigerant from a dump tank. A controlled pressure receiver receives liquid from the dump tank and recirculates it to an evaporator. The flash gas pressure in the flash tank is controlled by a pressure regulator valve connected between the controlled pressure flash tank and the controlled pressure receiver. The pressure regulator valve may set so that the flash gas in the flash tank is at the pressure needed to force liquid from the dump tank. Thereby, optimum refrigeration efficiency is achieved with very little energy waste.

9 Claims, 1 Drawing Sheet

RECIRCULATING REFRIGERATION SYSTEM

FIELD OF THE INVENTION

This invention relates in general to a method and apparatus for recirculating liquid refrigerant. More particularly, this invention relates to the efficient use of gas pumping recirculation techniques in conventional industrial and commercial refrigeration air conditioning systems.

BACKGROUND OF THE INVENTION

In a conventional industrial or commercial refrigeration/air conditioning system, gas refrigerant is compressed in a compressor and discharged at a higher temperature and pressure. The compressed gas travels to a condenser, which removes heat from the gas and condenses the gas to liquid. The liquid then travels to an evaporator, which performs its cooling or refrigeration function by evaporating the liquid into gas. As the liquid evaporates, heat is removed from the surrounding environment through the evaporator coils.

One method for feeding liquid refrigerant to the evaporator coils is known as the "flooded" evaporator method. With this method, the evaporator is literally flooded by sending more liquid than the coils can evaporate. Evaporator coils work at optimum efficiency when their entire interior surface remains wet with liquid refrigerant. During the refrigeration process, a portion of the liquid in the evaporator is vaporized into gas. Gas and liquid exit the evaporator and are sent to a gas/liquid separator known as a surge drum. If the system includes more than one evaporator, a single liquid/gas separator known as an accumulator can service several evaporators at the same time.

Liquid from the surge drum or accumulator must be recirculated to the evaporator. Recirculation may be accomplished by mechanical pumps, or by utilizing the gas pressure existing in the system. Gas pressure pumping has several advantages over mechanical pumping, including lower initial installation costs and being virtually maintenance free.

One type of ammonia gas pumping recirculation system is manufactured by H. A. Phillips & Company. In the Phillips system, excess liquid is directed from the accumulator to a dump tank. When the liquid in the dump tank exceeds a predetermined level, high pressure hot gas at approximately 150 psig is fed to the dump tank from downstream of the compressor, thereby forcing liquid from the dump tank into a receiver tank. The liquid in the receiver tank is forced into the evaporators by the gas pressure maintained in the receiver tank.

Although the Phillips gas pumping system has several advantages over mechanical pumping, the Phillips system, as well as other gas pumping systems, can be improved upon. For example, in a single stage (i.e., one compressor) system, it has been found that the gas taken from the output of the compressor is at a much higher pressure than is needed to force liquid from the dump tank. The unused energy associated with the excess pressure is wasted. Because the high pressure gas is also at a very high temperature, heat is discharged into the system, thereby reducing the overall refrigeration efficiency.

U.S. Pat. No. 4,059,968 to Ross (Ross '968 patent) discloses a recirculating refrigeration system that utilizes flash (vaporized) gas at approximately 50 psig (for ammonia) to force liquid refrigerant from a dump tank, 44 or 144. The Ross '968 patent is directed primarily to the effective use of a three-port "economizer" compressor, 30 or 130, having two inlet ports and one outlet port. One inlet port 51 accepts vaporized refrigerant from an accumulator, 41 or 141, and the other inlet port 53 accepts flash gas from a receiver, 16 or 116A. These inputs are compressed and discharged from outlet port 52 at approximately 150 psig.

Although the three-port compressor, 30 or 130, normally has low maintenance costs, it is expensive and can only be used for systems with stable operating conditions. A change in an operating condition, such as evaporating temperature, will cause a change in refrigeration capacity. At refrigeration capacity below 85% of design capacity, the port 53 is exposed to suction pressure, and the "economizer" effect disappears. As a result, two-port compressors are still preferred in recirculating refrigeration systems.

The '968 patent does not solve the problems associated with utilizing pumping gas at a higher pressure than needed to recirculate the liquid. For example, the pressure of the flash gas taken from the flash receiver tank, 16 or 116*a*, is set by the screw compressor's built-in volumetric ratio. This pressure is limited to a certain range defined by the "intermediate" inlet port 53 and the outlet port 52. Thus, the '968 patent does not adjust the pumping gas pressure to the needs of the system.

Thus, it can be seen that, although gas pumping systems have in general presented improvements over mechanical pumping systems, a system has not been presented that provides the optimum efficiency associated with utilizing pumping gas at the pressure needed.

It is thus an object of this invention to provide a gas pumping recirculation system that is extremely efficient and wastes very little energy.

It is a feature of this invention to provide at least one adjustable pressure regulator valve for controlling the pressure difference between a flash tank and a receiver tank. Pumping gas is taken from the flash tank, and the valve can be set so that the pumping gas pressure is at the level needed to recirculate liquid refrigerant.

It is an advantage of this invention that the compressor is not directly involved in setting the pumping gas pressure, and therefore, the compressor has less requirements placed on it.

It is another advantage of this invention that the pumping gas pressure can be easily adjusted to meet the needs of different systems, or to meet the variable needs within one system.

It is a further advantage that this invention virtually eliminates the waste associated with utilizing pumping gas at a pressure higher than needed to recirculate liquid refrigerant.

SUMMARY OF THE INVENTION

The foregoing and other objects are realized by providing a refrigeration system wherein a conventional two-port reciprocating compressor compresses refrigerant gas (for instance ammonia) to an output pressure of approximately 150 psi. A condenser receives the compressed gas from the compressor and liquifies it, directing the liquid refrigerant to a first container or "controlled pressure flash tank" at a lower pressure. A second container or "controlled pressure receiver" receives liquid from the controlled pressure flash tank at an even lower temperature and pressure. The controlled pressure receiver feeds liquid refrigerant to the evaporator at a low temperature and pressure and in an excessive quantity (flooded).

A combination of liquid and gas refrigerant exits the evaporator and flows to a surge drum, which separates the liquid from the gas. The gas is returned to the compressor, and the liquid flows into a dump tank under the force of gravity. When the liquid in the dump tank reaches a predetermined level, flash gas is fed to the dump tank from the controlled pressure flash tank and forces liquid from the dump tank into the controlled pressure receiver. The gas pressure in the flash tank is set by a pressure regulator valve, which maintains a minimum pressure difference between the controlled pressure flash tank and the controlled pressure receiver. This pressure difference can be controlled and set so that the gas pressure in the flash tank is at the level needed to pump liquid from the dump tank to the controlled pressure receiver.

BRIEF DESCRIPTION OF THE DRAWINGS

The invention is illustrated schematically in the following drawing, in which.

DETAILED DESCRIPTION OF THE PRESENTLY PREFERRED EMBODIMENTS

Figure 1:
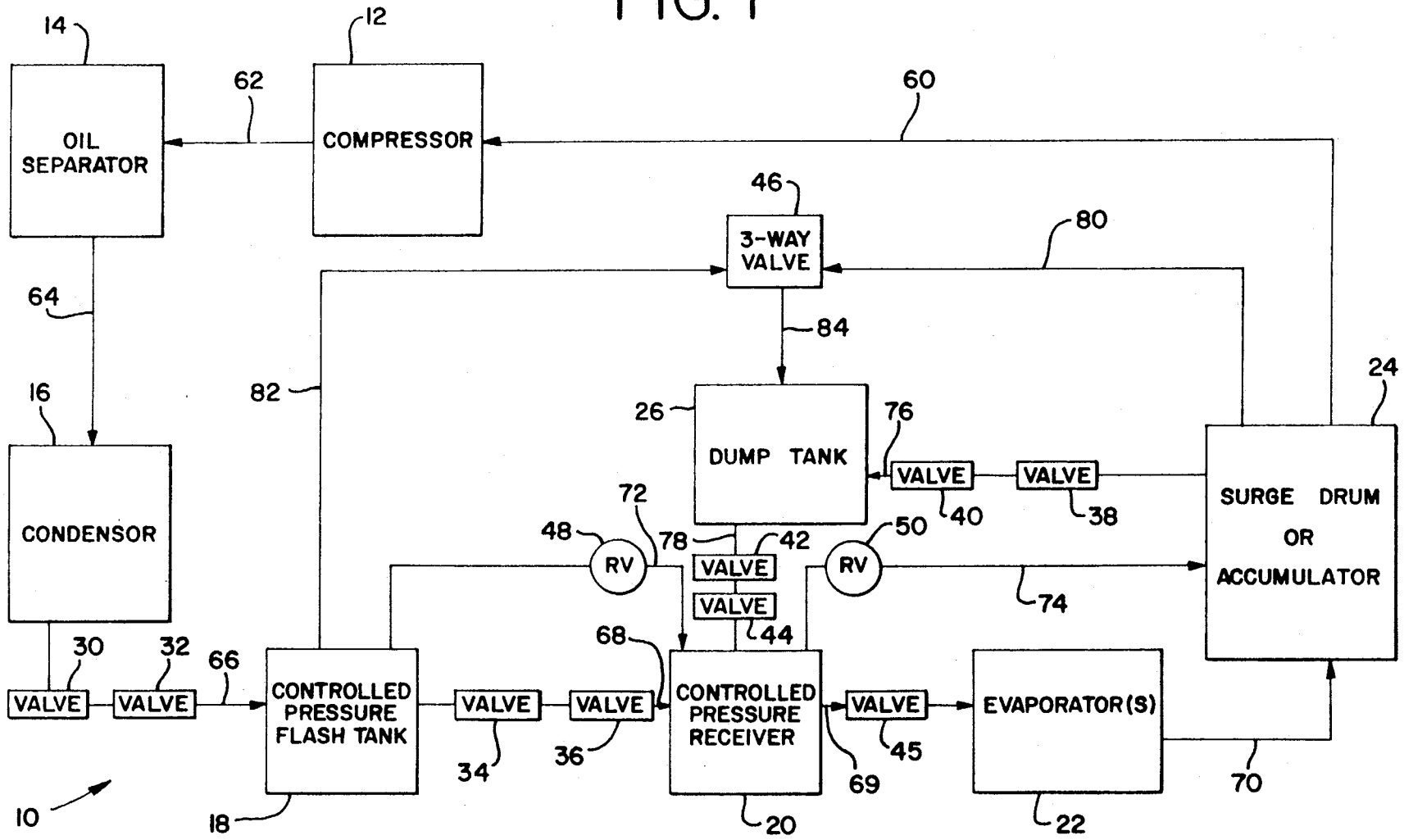
FIG. 1 is a schematic illustration of the gas pumping recirculating refrigeration system incorporating the improvements of the present invention.

Referring now to FIG. 1, a gas pumping recirculating refrigeration system embodying the basic features of the invention is illustrated schematically at 10. The system 10 is extremely flexible and can operate at optimum efficiency by setting the pumping gas pressure to the level needed to recirculate liquid refrigerant.

A combination of liquid and gas refrigerant exits the evaporator 22 through pipe segment 70 and enters a surge drum 24. If the system includes more than one evaporator, the surge drum may be replaced by an accumulator. The surge drum 24 is a liquid/gas separator, which recirculates gas to the compressor 12 via pipe segment 60, and sends liquid to a dump tank 26 via pipe segment 76 for eventual recirculation to the evaporator 22. The compressor 12 can be a reciprocating compressor, a screw compressor or any other type of two-port compressor that draws gas to its inlet port by suction. The refrigerant gas is compressed in the compressor 12 to a high pressure, typically 150 psig for ammonia. The high pressure gas then leaves the compressor 12 via pipe segment 62 and enters an oil separator 20, which separates oil from the gas. The gas then flows through pipe segment 64 into a condenser 16, where the gas is condensed to liquid and sent out through pipe segment 66.

The condenser 16 is connected to a controlled pressure flash tank 18 via pipe segment 66, pilot float valve 30 and pilot operated valve 32. When the liquid level in the condenser 16 reaches a predetermined high value, the pilot float valve 30 opens the pilot operated valve 32 to allow only liquid refrigerant (vapor is blocked) to flow into the controlled pressure flash tank 18 through pipe segment 66. Conversely, when the liquid level in the condenser 16 reaches a predetermined low value, the pilot float valve 30 closes the pilot operated valve 32. The pilot operated valve 32 is an expansion device, which reduces the pressure of the liquid refrigerant that flows into the controlled pressure flash tank 18.

Liquid refrigerant flows from the controlled pressure flash tank 18 into a controlled pressure receiver 20 via pipe segment 68, pilot float valve 34 opens a pilot operated valve 36. The liquid level in the controlled pressure flash tank 18 is controlled by the pilot float valve 34, which functions in a manner similar to the valve 30. When the liquid level in the controlled pressure flash tank 18 reaches a predetermined level, the pilot float valve 34 opens a pilot operated valve 36 to allow only liquid refrigerant (vapor is blocked) to flow into the controlled pressure receiver 20 through pipe segment 68. Conversely, when the liquid level in the controlled pressure flash tank 18 reaches a predetermined low value, the pilot float valve 34 closes the pilot operated valve 36. The pilot operated valve 36 is an expansion device, which reduces the pressure of the liquid refrigerant that flows into the controlled pressure receiver 20.

Liquid refrigerant is fed from the controlled pressure receiver 20 to an evaporator 22 via pipe segment 68 and manual gate valve 45. The evaporator 22 performs the refrigeration or cooling operation by removing heat from the environment through the evaporator coils (not shown).

Because some of the liquid in the controlled pressure receiver 20 and the controlled pressure flash tank 18 vaporizes (flashes), flash gas is formed in both containers, 18 and 20. During the vaporizing process, the flashed liquid sub-cools the surrounding liquid by absorbing latent heat from the surrounding liquid. The remaining liquid increases its refrigeration capacity due to its lower temperature.

The controlled pressure flash tank 18 is connected to the controlled pressure receiver 20 via pipe segment 72 and pressure regulator valve 48. The flash gas pressure in the controlled pressure flash tank 18 is set by pressure regulator valve 48, which maintains a minimum pressure difference between the controlled pressure flash tank 18 and the controlled pressure receiver 20. The pressure in the controlled pressure receiver 20 is regulated primarily by venting vapor to the surge drum 24 via pressure regulator valve 50. The pressure difference (typically 10 to 15 psig) between the containers, 18 and 20, can be set so that the flash gas pressure in the controlled pressure flash tank is at the level needed to pump liquid from a dump tank 26 into the controlled pressure receiver 20.

Liquid from the surge drum 24 is recirculated to the evaporator 22 via the dump tank 26 and the controlled pressure receiver 20. As noted above, liquid in the surge drum 24 drains, usually by gravity, into the dump tank 26 through pipe segment 76, a manual gate valve 38 and a check valve 40. The gate valve 38 may be opened manually in order to service the system or in cases of emergency. The check valve 40 is a one-way device that prevents the backflow of fluid into upstream components. A solenoid operated three-way valve 46 has its common port connected to the dump tank 26 via pipe segment 84. The three-way valve 46 alternately connects its common port to the controlled pressure flash tank 18 via dumping pipe segment 82, or to the surge drum 24 via venting pipe segment 80.

When the three-way valve 46 is positioned to connect the venting pipe segment 80 to the common port, the pressure in the dump tank 26 is made equal to the pressure in the surge drum 24, thus allowing liquid to flow through pipe segment 76 by gravity. When the three-way valve 46 is positioned to connect the dumping pipe segment 82 to the dump tank 26, the flash gas in the controlled pressure flash tank 18 forces liquid from the dump tank 26 into the controlled pressure receiver 20 through a pipe segment 78, which includes a check valve 42 and a gate valve 44. Valves 42 and 44 operate in the same manner as valves 40 and 38 respectively. The liquid in the controlled pressure receiver 20 is transferred to the evaporator 22 (via pipe 69 and manual gate valve 45) by the gas pressure maintained in the receiver 20.

The system 10 will now be described in relation to an ammonia refrigeration system operating in a meat processing plant. The typical evaporating temperature in such a refrigeration system is −40° F., corresponding to the evaporating pressure 8.7 in-Hg. The pressure regulator valve 50 is set such that a gas pressure difference of 25 psig is maintained between the receiver 20 and the evaporator 22. This pressure difference generally is enough to feed the liquid refrigerant from the receiver 20 (which is at a pressure of 20.7 psig) to the evaporator 22. The pressure regulator valve 48 is set such that a gas pressure difference of 10 psig is maintained between the flash tank 18 and the receiver 20. This pressure difference generally is enough to feed the liquid refrigerant from the dump tank 26 to the receiver 20. Thus, the gas pressure in the flash tank 18 is 30.7 psig. The pressure settings for the pressure regulator valves 48 and 50 are dependent upon the flow resistances of the system piping. The typical values for valves 48 and 50 are 10 to 15 psig and 25 to 30 psig, respectively.

As the gas in the flash tank 18 evaporates from the liquid, it sub-cools the liquid by removing latent heat and increases the refrigeration capacity of the liquid by an amount equal to the latent heat. Because the pumping gas is at the pressure needed to force liquid from the dump tank 26, the gas transfers less heat to the liquid in the dump tank 26 and condenses less. Thus, the refrigeration capacity loss is greatly reduced.

While a preferred embodiment of the invention has been described herein, it is understood that various modifications and improvements may be made without departing from the scope of the invention. All such modifications and improvements as fall within the true spirit and scope of the invention are intended to be covered by the appended claims.

I claim:

1. An improved gas pumping recirculation system for recirculating liquid refrigerant to an evaporator, the system comprising:

a) a compressor in fluid connection with a condenser;

b) said condenser in fluid connection with a flash tank;

c) said flash tank in fluid connection with a receiver tank;

d) said receiver tank in fluid connection with an evaporator;

e) said evaporator in fluid connection with a surge drum;

f) said surge drum in fluid connection with said compressor;

g) said surge drum also in fluid connection with a dump tank such that liquid from said surge drum can flow into said dump tank;

h) said dump tank also in fluid connection with said receiver tank such that liquid can flow from said dump tank into said receiver tank;

i) said dump tank also in fluid connection with said flash tank such that flash gas from said flash tank can flow into said dump tank, thereby forcing liquid from said dump tank into said receiver; and j) a first regulator valve connected to said flash tank for regulating flash gas pressure in said flash tank, whereby the flash gas pressure may be set to the amount necessary to force liquid from said dump tank.

2. The system defined in claim 1 wherein said first regulator valve is connected between said flash tank and said receiver for maintaining a minimum pressure difference between said flash tank and said receiver, thereby controlling the flash gas pressure.

3. The system defined in claim 2 wherein a second regulator valve is connected to said receiver for controlling the pressure in said receiver and thereby further controlling the flash gas pressure.

4. The system defined in claim 1 wherein there are a plurality of evaporators, and said surge drum is replaced by an accumulator, which is connected to and services said plurality of evaporators.

5. The system defined in claim 1 wherein:

a three-way valve connects said flash tank and a gas vent port of said surge drum to said dump tank; and said three-way valve may be controlled to connect said dump tank to said flash tank such that flash gas flows from said flash tank into said dump tank, or to connect said dump tank to said gas vent port of said surge drum such that gas pressure in said dump tank will become equal to the gas pressure in said surge drum.

6. A method for recirculating liquid refrigerant in a refrigeration system comprising the steps of a) compressing refrigerant gas in a compressor;

b) condensing said refrigerant gas to a liquid;

c) storing said liquid in a flash tank;

d) transferring said liquid to a receiver tank;

e) transferring said liquid from said receiver tank to an evaporator, which transfers heat from the surrounding environment to said liquid, thereby flashing part of said liquid and creating a liquid/gas mixture;

f) separating the liquid from said liquid/gas mixture and transferring said liquid to a dump tank;

introducing flash gas from said flash tank into said dump tank for pumping liquid from said dump tank into said receiver; and h) attaching a pressure regulator valve to said flash tank for regulating the pressure of the flash gas introduced into said dump tank.

7. The method defined in claim 6 including the step of:

attaching said pressure regulator valve between said flash tank and said receiver tank such that the pressure of said flash gas is regulated by maintaining a pressure difference between said flash tank and said receiver tank.

8. The method defined in claim 7 including the step of:

attaching a second pressure regulator valve to said receiver tank for controlling the pressure in said receiver and thereby further controlling the pressure of said flash gas.

9. The method defined in claim 6 including the step of:

setting said flash gas pressure at the level needed to pump liquid from said dump tank.

* * * * *

UNITED STATES PATENT AND TRADEMARK OFFICE

CERTIFICATE OF CORRECTION

PATENT NO. : 5,189,885
DATED : March 2, 1993
INVENTOR(S) : Shimao Ni

It is certified that error appears in the above-indentified patent and that said Letters Patent is hereby corrected as shown below:

In column 1, line 9, delete "refrigeration air" and substitute therefor --refrigeration/air--.

In column 4, line 41, after "tank " insert --18--.

Column 6:

In claim 6, line 2, after "steps of" insert --:--.

In claim 6, line 14, start a subparagraph and insert --g)-- before "introducing".

Signed and Sealed this

Twenty-sixth Day of April, 1994

Bruce Lehman

*Attest:*

BRUCE LEHMAN

*Attesting Officer*

*Commissioner of Patents and Trademarks*